United States Patent [19]

Morrison et al.

[11] 4,216,965

[45] Aug. 12, 1980

[54] MICROCOMPUTER CONTROLLED ELECTRONIC GAME APPARATUS

[75] Inventors: Howard J. Morrison, Deerfield, Ill.; Ralph H. Baer, Manchester, N.H.; Jeffrey D. Breslow, Highland Park, Ill.

[73] Assignee: Marvin Glass & Associates, Chicago, Ill.

[21] Appl. No.: 865,898

[22] Filed: Dec. 30, 1977

[51] Int. Cl.[3] ..... A63B 71/04

[52] U.S. Cl. ..... 273/237; 273/1 E; 273/138 A

[58] Field of Search ..... 273/1 E, 85 G, 138 A, 273/237; 35/6, 22 R; 180/99; 235/92 GA; 340/279, 384 R, 384 B; 364/200, 410, 411, 900

[56] References Cited

U.S. PATENT DOCUMENTS

| | | | |
|---|---|---|---|
| 3,367,653 | 2/1968 | Brown | 273/1 E |
| 3,367,663 | 2/1968 | Marks | 273/237 |
| 3,376,041 | 4/1968 | Anderson | 273/1 E |
| 3,417,995 | 12/1968 | Creeley | 273/1 E |
| 3,654,710 | 4/1972 | Barnard | 273/1 E |
| 3,690,665 | 9/1972 | Becker | 273/237 |
| 3,779,553 | 12/1973 | Secter | 273/237 |
| 3,869,812 | 3/1975 | Arakelian | 35/22 R |
| 3,922,665 | 11/1975 | Curry et al. | 340/279 |
| 3,942,151 | 3/1976 | Takeuchi | 180/99 X |
| 3,982,764 | 9/1976 | Dieball | 273/1 E |
| 4,000,489 | 12/1976 | Bench | 273/1 E X |
| 4,060,242 | 11/1977 | Huang et al. | 273/1 E |

OTHER PUBLICATIONS

Popular Electronics, "Logidex An Electronic Game for All Seasons; " Nov. 1973, pp. 63–66.

Electronics, "Games", Jun. 24, 1976, pp. 89–96.

"Touch-Me", Operating and Maintenance Manual, 1974, pp. 1–8.

*Primary Examiner*—Vance Y. Hum

*Attorney, Agent, or Firm*—Mason, Kolehmainen, Rathburn & Wyss

[57] ABSTRACT

A sequence association game in which a participant may play one or more games against the machine and/or other participants utilizes a microprocessor for controlling the play of the games and also for generating a random sequence for each play of the game. The machine generates a random sequence correspondence between a plurality of participant actuated controls and a plurality of machine actuated indicators. The participant attempts to actuate the indicators by correctly establishing the random-generated correspondence between the controls and the indicators in an attempt to actuate all the indicators in sequence such as from left to right. The participant attempts to actuate the indicators with the least number of attempts by attempting to remember the association between respective controls and indicators from previous attempts. When played between two participants, each participant attempts to actuate or deactuate a designated set of indicators by operating a designated set of controls with the participant first succeeding being the winner. Two participants may also play with one participant starting from the left of the indicator sequence and one participant starting at the right with each attempting to actuate the maximum number of indicators with play proceeding until all the indicators are actuated.

20 Claims, 6 Drawing Figures

B
A
INITIALIZE TURN TIMER
DECREMENT TURN TIMER
TURN TIME UP ?
YES
NO
D
INCREMENT ROUND COUNT
F
READ SWITCHES CONTROL IND.
OUTPUT TONE ?
YES
NO
ENABLE TONE GENERATOR
DISABLE TONE GENERATOR
DONE MELODY ?
NO
YES
DETERMINE NEXT TONE TYPE
GAME END MELODY ?
YES
E
NO
NEW MELODY ?
YES
NO
DETERMINE MELODY TYPE
C

MICROCOMPUTER CONTROLLED ELECTRONIC GAME APPARATUS

BACKGROUND OF THE INVENTION

A. Field of the Invention

The invention relates generally to games and more particularly to an electronic board game that provides aural and visual indications of the progress of the game to the participant.

B. Description of the Prior Art

Various games are known wherein one or more players are provided with a number of switches that are connected to light bulbs or other indicators in a manner unknown to the players; the player or players attempting to light and/or extinguish lights of an opposing player, to actuate a series of indicators sequentially or to form a particular pattern.

For example, U.S. Pat. No. 3,690,665 which issued to N. Becker on Sept. 12, 1972, provides a plurality of switches for each player that are interconnected to operate a plurality of light bulbs. The switches are operative to light one of the bulbs associated with one player while simultaneously switching off one of the bulbs of an opposing player. Thus, the operation of one player's switches is controlled by the setting of the other player's switches so that neither player can anticipate the result of any switching action he may initiate. Various double-pole, double-throw switches and their interconnection are described.

Similarly, U.S. Pat. No. 3,417,995 which issued to R. J. Creeley on Dec. 24, 1968, is directed to a game having a game board in the shape of a race track and provided with a plurality of lights to indicate the position of each player along the race track. The light bulbs are randomly connected to the push buttons with the players attempting to actuate their corresponding light bulbs around the race track as fast as possible. The push buttons are connected to the light bulbs by means of rotary switches and solenoids; the connections being alterable by a mechanical switch arrangement. Thus, the players do no know the correspondence between the positions on the race track and the push buttons.

An electronic tic-tac-toe game is disclosed in U.S. Pat. No. 3,367,663 which issued to L. A. Marks on Feb. 6, 1968. Each player is provided with nine push buttons that correspond to one square of the tic-tac-toe board. The interconnections between the push buttons and the tic-tac-toe squares are alterable at random and the players do not know the correspondence between the push buttons and a particular square on the tic-tac-toe board.

U.S. Pat. No. 3,092,390 which issued to C. J. Super on June 4, 1963, is directed to a game device wherein a plurality of switches are arranged in a plurality of rows with one switch in each row being electrically connected to a bulb. The object of the game is to select the switch in each row that lights the bulb, the player proceeding from row to row. If the player is not successful in choosing the right switch that lights the bulb, another player takes a turn. The interconnections between the switches and the bulb are random and are made by metallic balls located between the switches and the housing with the interconnections being alterable by shaking the device.

A hand-eye coordination device is associated in U.S. Pat. No. 3,654,710 which issued to J. W. Barnard on Apr. 11, 1972. In this device, a rotary switch sequentially lights up a plurality of light bulbs mounted on a board upon rotation of the switch by an attached knob.

U.S. Pat. No. 3,367,653 which issued to M. E. Brown on Feb. 6, 1968, is directed to a board game with each player operating a pair of rotary switches connected in series with one another such that a light is actuated when the two switches are set to the same position.

U.S. Pat. No. 3,376,041 which issued to F. P. Anderson on Apr. 2, 1968, is directed to a battleship or other target game utilizing a board and various array positions with interconnected switches. This game board is arranged to play the traditional "battleship" game.

Another game directed to interconnected switch arrangements is described in U.S. Pat. No. 3,779,553 which issued to M. Secter on Dec. 18, 1973. In this game, a matrix of switches is provided for each player on opposite sides of a housing wherein each player attempts to electrically connect the switches in one row or column of his matrix. The time that such switches are interconnected is recorded on a clock. The opposing player attempts to break the electrical circuit by manipulation of his matrix swtiches. The highest accumulated interconnection clock time determines the winner.

A game utilizing a scrambler switch interposed between a plurality of switches and the segments of an alpha-numeric display is disclosed in U.S. Pat. No. 3,982,764 which issued to W. L. Dieball on Sept. 28, 1976. The object of the game is to form a particular number or character on the display. The player who first forms the designated number or character is the winner. The scrambler is positionable to provide different connections between the switches and the display segments.

U.S. Pat. No. B 4,060,242 which issued to T. L. Huang et al on Nov. 29, 1977, is directed to a game including a series of lights that are rapidly and repeatedly illuminated in succession to simulate a rapidly moving light path. The speed of the illumination may be varied and a player attempts to stop the path on a particular light or a light with a high score associated therewith. Various patterns of lights are described.

Other board games of the prior art including electrical switches and light indicators are found in the following U.S. Pat. Nos.: 3,563,552; 3,626,698; 4,002,340; and 4,021,044.

While the above described prior art games do provide a great deal of amusement, there is a constant need and desire for improved electronic games that utilize electronic control circuitry for establishing a random association between player operated devices and indicators and also controlling the progress of the game to provide an increased variety of play, challenge and interest while improving memory skills.

SUMMARY OF THE INVENTION

Accordingly, it is an object of the present invention to provide a game including a microprocessor that controls the progress of the game played by one or more participants against the machine and/or other participants.

It is another object of the present invention to provide a game that tests the memory of a participant against the machine.

It is yet another object of the present invention to provide a microprocessor controlled game that can be programmed to play various types of games; a large number of different sequence associations for each play of the game being provided as a challenging memory test.

It is another object of the present invention to provide an electronic game which generates a random sequence correspondence between a plurality of participant actuated controls and a plurality of indicators; the electronic game comparing the sequence in which the controls are actuated by the participant with the random generated sequence.

In accordance with a preferred embodiment of the present invention, there is provided a device having a plurality of push button switches and a plurality of indicating devices. The device utilizes a microprocessor programmed to generate a random sequence correspondence between the switches and the indicators; the participant attempting to actuate the indicators in order such as from to right by operating the proper push button switches in the proper order. As the participant operates various push button switches, the device momentarily actuates the corresponding indicators according to the random generated sequence stored in the device. If the participant operates the switch corresponding to the first indicator in the sequence, for example, the indicator remains actuated. The participant continues to select and operate switches with the device actuating corresponding indicators according to the stored sequence for the particular play of the game. In order to actuate all the indicators in the sequence the participant attempts to remember the correspondence between the switches and the indicators in order to minimize the number of attempts. The microprocessor controls the play of the game and provides the participant with distinct indications, both visual and aural, as to correct and incorrect sequence operation of the push button switches, the time alotted for each turn or attempt being exceeded, and the successful completion of the game.

In an alternative embodiment, the microprocessor is programmed to penalize the participant for actuating a push button switch which has previously been successfully pushed to actuate an indicator in sequence by extinquishing all successfully actuated indicators in the stored sequence after and including a particular indicator upon operation of the corresponding push button switch. The participant must then go back in the sequence and attempt to reactuate the indicators in sequence starting from the particular indicator corresponding to the switch incorrectly operated.

In other alternative embodiments, two participants compete against each other and the machine simultaneously; each participant attempting to actuate or deactuate a designated group of the indicators. The participant successfully actuating or deactuating the larger number of indicators in the proper order being the winner.

DESCRIPTION OF THE DRAWINGS

These and other objects and advantages of the present invention will become apparent by reference to the following description taken in conjunction with the accompanying drawings wherein.

DETAILED DESCRIPTION OF THE PREFERRED EMBODIMENT

Figure 1:
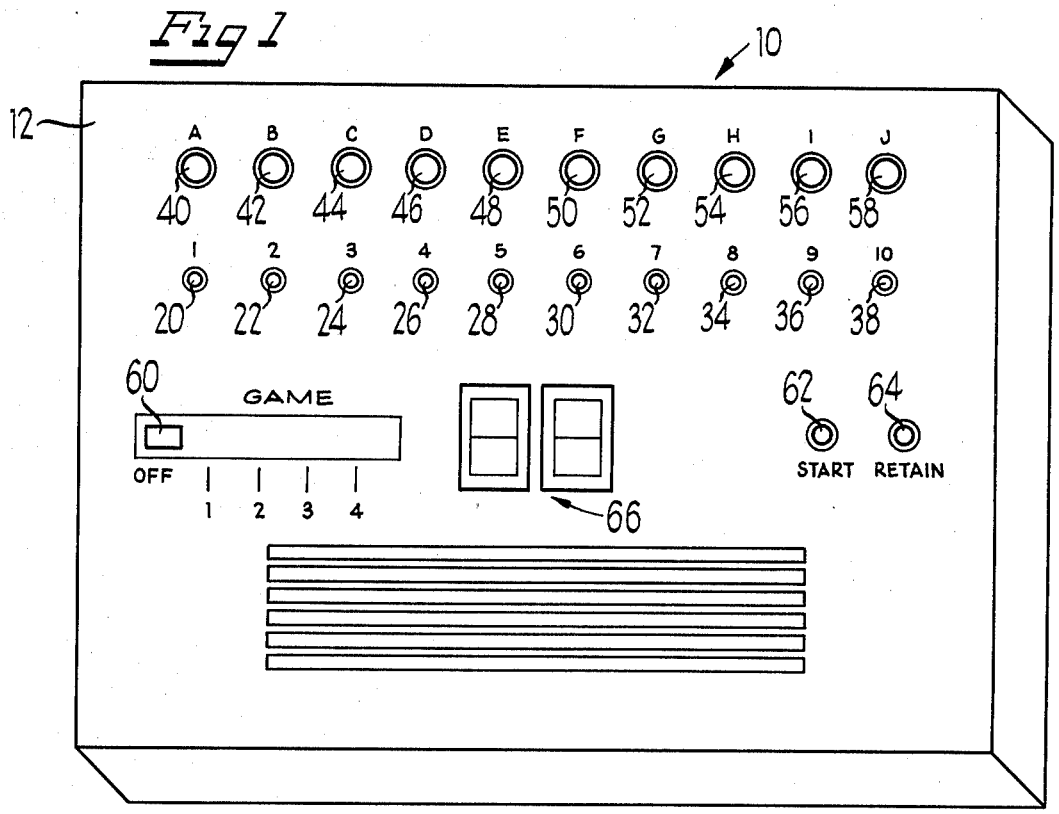
FIG. 1 is a perspective view of a preferred embodiment of a device according to the invention.

Referring now to the drawings, with particular attention to FIG. 1, there is shown an embodiment of the game according to the present invention generally designated by the reference numeral 10. The game 10 includes a housing 12 that carries ten push button switches 20 through 38 that are operable by a game participant. Each of the push button switches 20 through 38 is associated with a particular one of ten indicators 40 through 58 in accordance with the internal operation and control logic of the game as will be explained in more detail hereinafter. In a specific embodiment, the indicators 40 through 58 are lamps or LED devices. The push button switches 20 through 38 are arranged generally across the housing 12 and the ten indicators 40 through 58 are generally disposed above the push button switches and are also arranged across the housing 12 in a manner generally parallel to the push button switches.

In a specific embodiment, the ten pushbutton switches 20 through 38 may be respectively associated with indicia arranged on the housing, for example the numerals "1 through 10". Further, the indicia "A through J" may be arranged on the housing 12 and respectively associated with the ten indicators 40 through 58.

Alternatively, the indicia on the housing associated with the push button switches 20 through 38 are the letters "A through J" and the numerals "1 through 10" associated with the indicators 40 through 58. The use of indicia other than numerals or letters is also contemplated in other embodiments. For versatility in play, a single device 10 may be provided with alterable designations for the push button switches and the indicators. The importance of the respective designations of the push button switches and the indicators arises due to the interrelationship or association required by a participant when attempting to remember the sequence as established during play. For example, if letters are utilized as indicia for the indicators, a particular participant may find it easier to remember a sequence of letters as opposed to remembering the Greek alphabet, arbitrary symbols, geometrical shapes or numbers. A participant skillful at remembering letter sequences, for example, would find the play of the game more difficult if numeral or arbitrary non-sequence indicia were utilized for the indicators than if letters were utilized. Many people find it more difficult to remember a sequence of ten numbers than a sequence of ten letters, especially if the letters form a phrase, word or sequence with mnemonic importance. Thus, the use of numerals for many people would render play more challenging.

In specific embodiments and to make the play of the game more interesting and more difficult, no indicia whatsoever or random order indicia are provided. Therefore, in the following description of various schemes of play, the use of numerical indicia for the switches and letter indicia for the indicators would be interpreted as illustrative and not in a limiting sense.

Further the number of push button switches and indicators may also be varied and in a specific embodiment may be unequal; i.e. 15 push button switches and 12 indicators may be provided. In that case, three of the push button switches may be "duds" and not associated with any indicator sequence. Alternatively, one push button may be arranged to actuate two indicators. It should also be understood that alternatives to the push buttons to perform the participant operable control function are also contemplated; e.g. key pad switches.

A game selector, slide switch 60 permits the user to select one of several types of games playable by the device. A start, push button switch 62 is also provided to initiate the play of the game and a retain or replay, push button switch 64 is also provided to allow the successive playing of the same game and the identical correspondence between the push button switches 20 through 38 and the indicators 40 through 58. In a specific embodiment, a slide switch is utilized for the retain or replay function. In one position, a new random sequence for each play of the game is provided; in the other position a retain or replay function is provided. A display 66 in a specific embodiment comprising two seven bar or segment LED indicators is also provided to indicate the number of attempts utilized by each participant in the play of the game and to perform other indicative functions.

Several types of games may be played by the device 10 illustrated in FIG. 1. The type of game is selected by appropriately positioning the slide switch 60. Four games are described below. However, the microprocessor (described in the subsequent portion of the specification) may be programmed to play various other types of games as well. Thus, the four games described below should be interpreted as illustrative of the games that can be played.

GAME 1

With the game selector, slide switch 60 in the first game position indicated by the numeral "1" on the housing 12 of FIG. 1, the type of game programmed as game 1 of the device will be activated when the start game, push button switch 62 is operated. In this game, the participating player attempts to actuate all ten indicators 40 through 58 in the proper order with the least number of operations of the push button switches, hereinafter referred to as rounds. Thus, the participant will find it helpful to remember which indicators are associated with corresponding push buttons to actuate all the indicators in the least number of rounds or push button operations.

At the start of the play of the game, the display 66 will indicate 00 and each time the participant operates one of the push buttons 20 through 38 (1 through 10) the display 66 will increment or count by one digit to display the number of rounds. The display 66 will also be incremented if the predetermined time for a turn alotted to actuate the next push button is exceeded. Thus if the participant does not timely press a push button, he is penalized by a round increment as if he had operated a wrong push button.

When the push button switch corresponding to or associated with indicator 40 (A) is operated, this indicator A will remain actuated. If the participant in previous rounds or attempts had operated the push button switch associated with the second indicator B in the internally stored sequence, the participant would then operate that push button and thus indicator B in the sequence will remain actuated. Continuing this procedure, the participant continues operating push button switches until all ten indicators A through J (40 through 58) remain actuated whereupon the game is completed. The display 66 after completion of the game indicates the total score corresponding to the total number of rounds, i.e. push button operations and penalties for excessive time. Typically, a good score for Game 1 is 20 or under.

During play, the indicators will only remain actuated after a push button is released if the indicator corresponding to the push button that is operated is the next indicator to be actuated in the sequence. If a participant has succeeded after various operations of the push buttons to actuate the first two indicators "A" and "B", the "C" indicator will be actuated and remain actuated upon operation of the push button corresponding to the "C" indicator as determined by the internal logic of the device.

During the play of the game, several distinct aural indications are also transmitted to the participant to advise the participant of the progress of the game and the correctness or incorrectness of his rounds. For example, a tone or tone sequence referred to as a melody is transmitted denoting a wrong push button operation whenever a push button is operated that does not correspond to the next indicator in the sequence. Further, an end-of-game tone sequence or melody and a correct sequence push button operation melody are also provided.

The microprocessor and associated control circuitry of the game device 10 are programmed to generate these distinct melodies, to control the progress of the game, to generate the random association of the push button switches 20 through 38 and the indicators 40 through 58, to compare the push button operation with the proper sequence order, to increment the display output 66, to control the actuation of the indicators in response to push button operations, and to control the continued actuation of the indicators properly sequenced by the participant.

It should be understood that variations within the basic provisions outlined in Game 1 may also be programmed. For example in one alternative embodiment, the device is programmed such that the operation of the push buttons in a proper sequence does not increment the display 66 to increment the round count. Thus, only errors or wrong rounds are counted. The retain push button switch 64 may be utilized to retain the same association sequence between the push button switches and the indicators to allow another participant to play the game under the same exact conditions; thus eliminating any differences in chance or luck as might be attributed to two different random sequences. Further, a participant may himself play a repeat game by operating the retain switch 64 to test his retention of the same association sequence after successfully completing a game by comparing the round counts.

After the conclusion of one play of the game, the participant has the option of starting a new game by operating the start game push button switch 62 or alternatively the participant may position the game selector switch 60 to another game type, game positions 2, 3 or 4.

GAME 2

By positioning the game selector switch 60 to the Game 2 position and depressing the start game button 62, the device 10 is conditioned to select and control the operation of Game 2. In this game, a participant depresses the push buttons to actuate the indicators in the same way as described in connection with Game 1.

However, in Game 2 whenever a participant operates a push button that is associated with an indicator that has already been actuated in the proper sequence and remains actuated, the participant is penalized; all indicators are extinquished that are equal to or farther along the sequence corresponding to the push button switch that is operated.

For example, if the indicators A, B, C, D, E and F are actuated thus far and the participant operates the push button associated with indicator B, the indicators F, E, D, C and B will be extinguished and only indicator A will remain actuated. The participant has then been penalized for operating a push button corresponding to an indicator already actuated in the sequence and thus must continue the play of the game by attempting to actuate indicators B, C, D, E and F.

GAME 3

This game allows for two participants to compete against each other and the device 10 upon positioning the game selector switch 60 to the Game 3 position. After the start game switch 62 is depressed, the microprocessor and control circuitry of the device 10 actuates the first five indicators A through E and initializes the indicators F through J in a deactuated or extinquished state.

One participant attempts to deactuate or extinquish all the indicators starting with A and continuing in sequence and the second participant attempts to actuate all the indicators starting with F. The game is completed when either participant succeeds in either actuating all ten indicators or deactuating all ten indicators whereupon that participant is declared the winner.For example, after the right hand participant succeeds in actuating indicator F, the left hand participant may deactuate indicator F by operation of the correct push button; provided that the left hand participant has successfully actuated the indicators A through E in sequence. Similarly, the right hand participant can not actuate indicator A until he has successfully activated the indicators F through J in sequence. The scheme of play may be accomplished by the rules of the games and/or by the programming of the microprocessor.

In the preferred scheme of play, the participants alternately select push buttons. Wrong selections or errors by a participant may either assist the other participant or penalize the participant making an error. In alternative embodiments, simultaneous selection or selection on an alternate turn basis until an error is made are also contemplated. In the case of simultaneous selection, the play of the game tests the reaction time and the manual dexterity of the participants.

The display in the Game 3 type play does not directly represent a score, but a high number of the display is indicative of a more competitive game or a more even match between the two players.

GAME 4

In the Game 4 position, the game device 10 is conditioned for a two participant game wherein a first participant attempts to actuate all the indicators starting with A and working toward J and a second participant attempts to actuate the indicators starting with J and working toward A. Play continues until all the indicators are actuated. The score for each participant is the number of indicators that each participant has actuated when the game ends.

For example, the first participant may have actuated the six indicators A through F and the second participant the four indicators J through G whereupon the first participant is declared the winner by a score of 6 to 4.

In various alternative schemes of play, the participants may either alternately select and operate push button switches or may simultaneously operate push buttons thus competing against each other as to time as well as correctness.

The above description of four types of games has been given by way of example only, the number of possible games is limited only by the capability of the microprocessor within the device and the ingenuity of the programmer. The number of games that may be played is of course considerably greater than the four examples and various modifications given.

Figure 2:
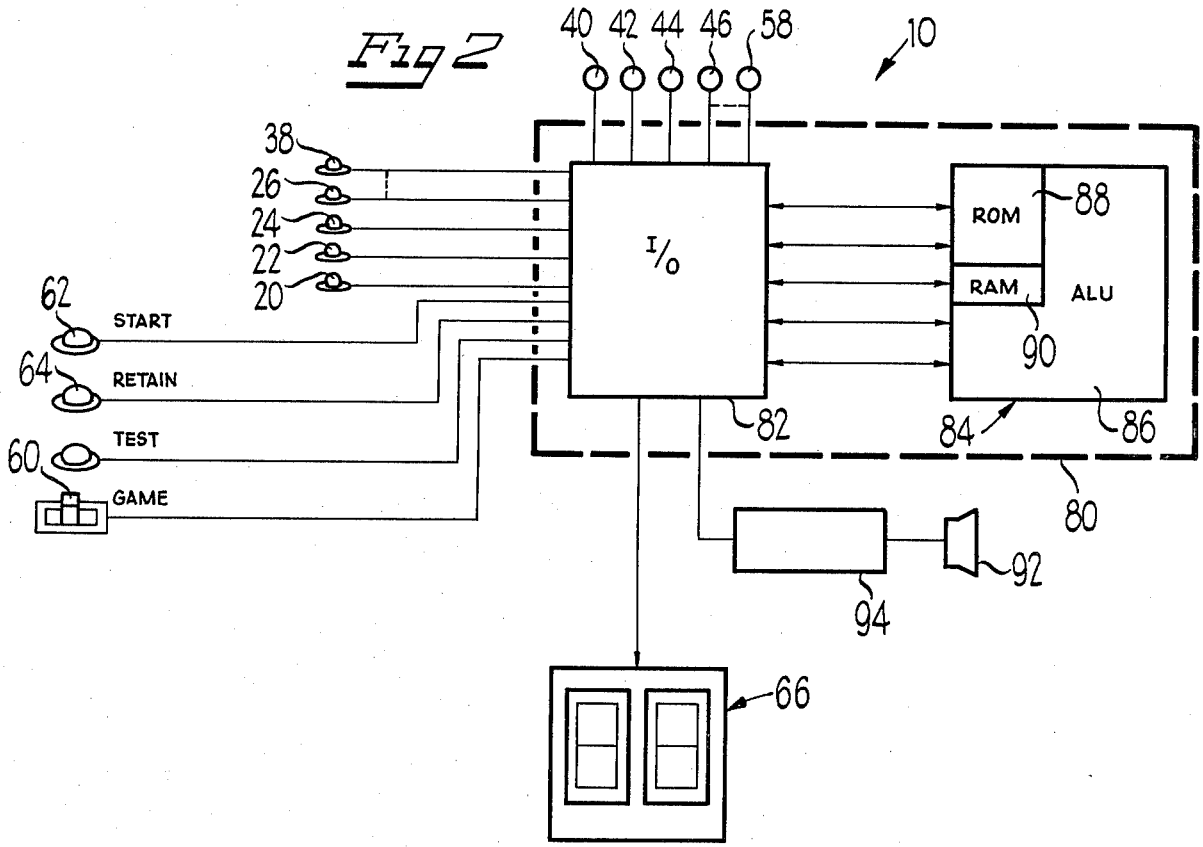
FIG. 2 is a block diagram of the electrical components of the game according to the invention.

Referring now to FIG. 2, the game device 10 utilizes a microprocessor 80 having an input/output section 82 connecting the manually operable push button switches 20 through 38 to a computing device 84 having an arithmetic logic unit 86, a read-only memory 88, and a random-access memory 90. The arithmetic logic unit 86 processes the inputs received through the various input devices in accordance with the game selected from the read-only memory 88 by the game selector switch 60 and serves to operate the ten indicators 40 through 58 and a loud speaker 92 with associated control circuitry 94 in accordance with the rules of the game selected.

Thus, when one of the games stored in the read-only memory 88 is selected by switch 60, the arithmetic logic unit 86 operates on the sample inputs from the ten push button switches 20 through 38 to perform the necessary arithmetic logic steps and to store the necessary data such as the operation of a correct switch in the sequence into the random-access memory 90. The arithmetic logic unit 86 also serves to provide the necessary responses to the participant by appropriately actuating the indicators 40 through 58, producing the appropriate tone sequence or melody through the loud speaker 92 and controlling the indicating state of the display device 66.

Figure 3:
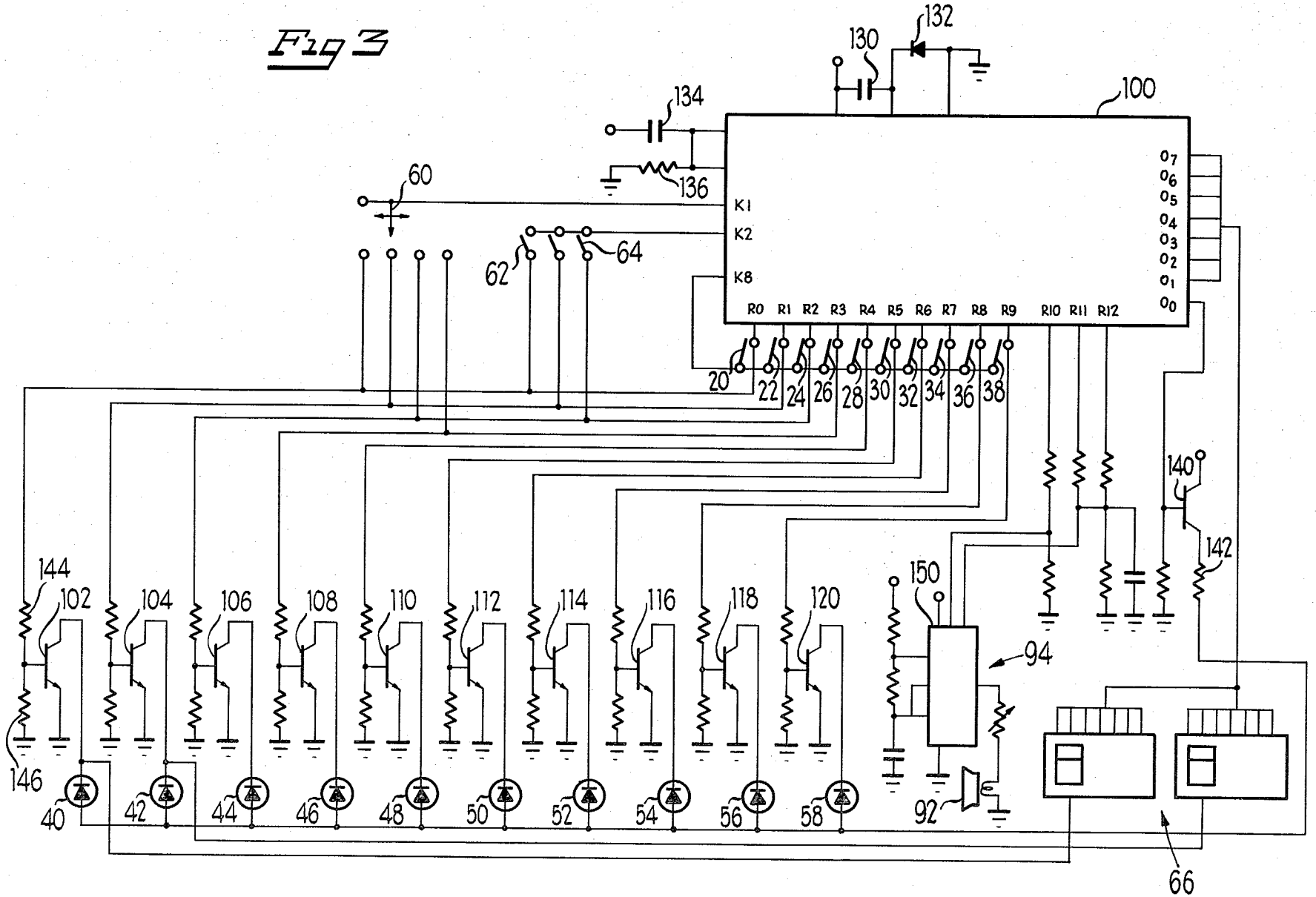
FIG. 3 is a detailed schematic diagram of the electronic circuitry of the game according to the present invention.
Figure 6:
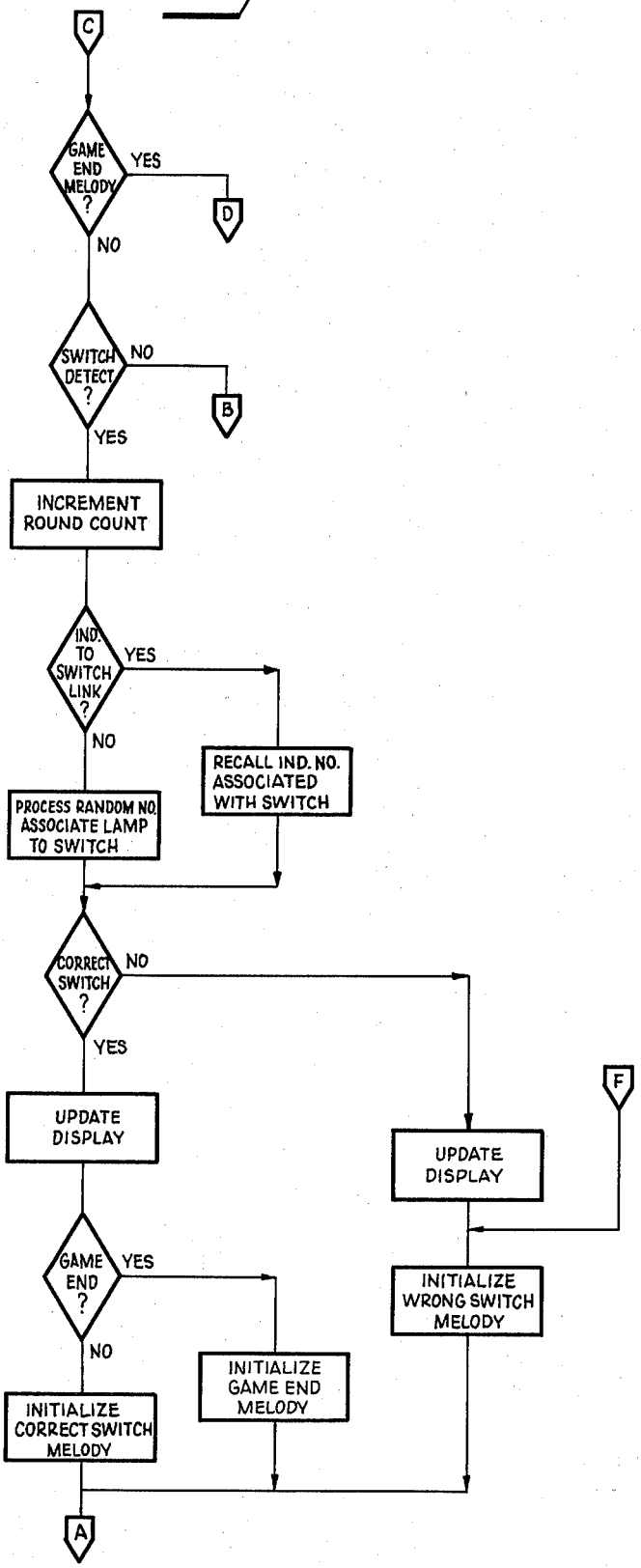
FIGS. 4 through 6 are logical flow diagrams illustrating the functions performed by the microprocessor controlling the operation of the game according to the invention.
Figure 4:
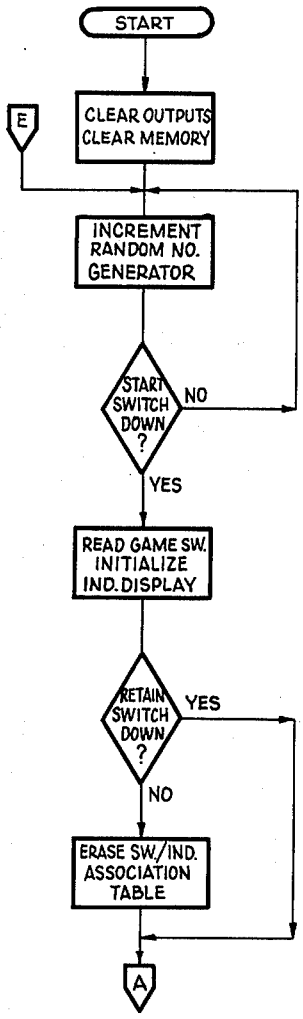
Figure 5:
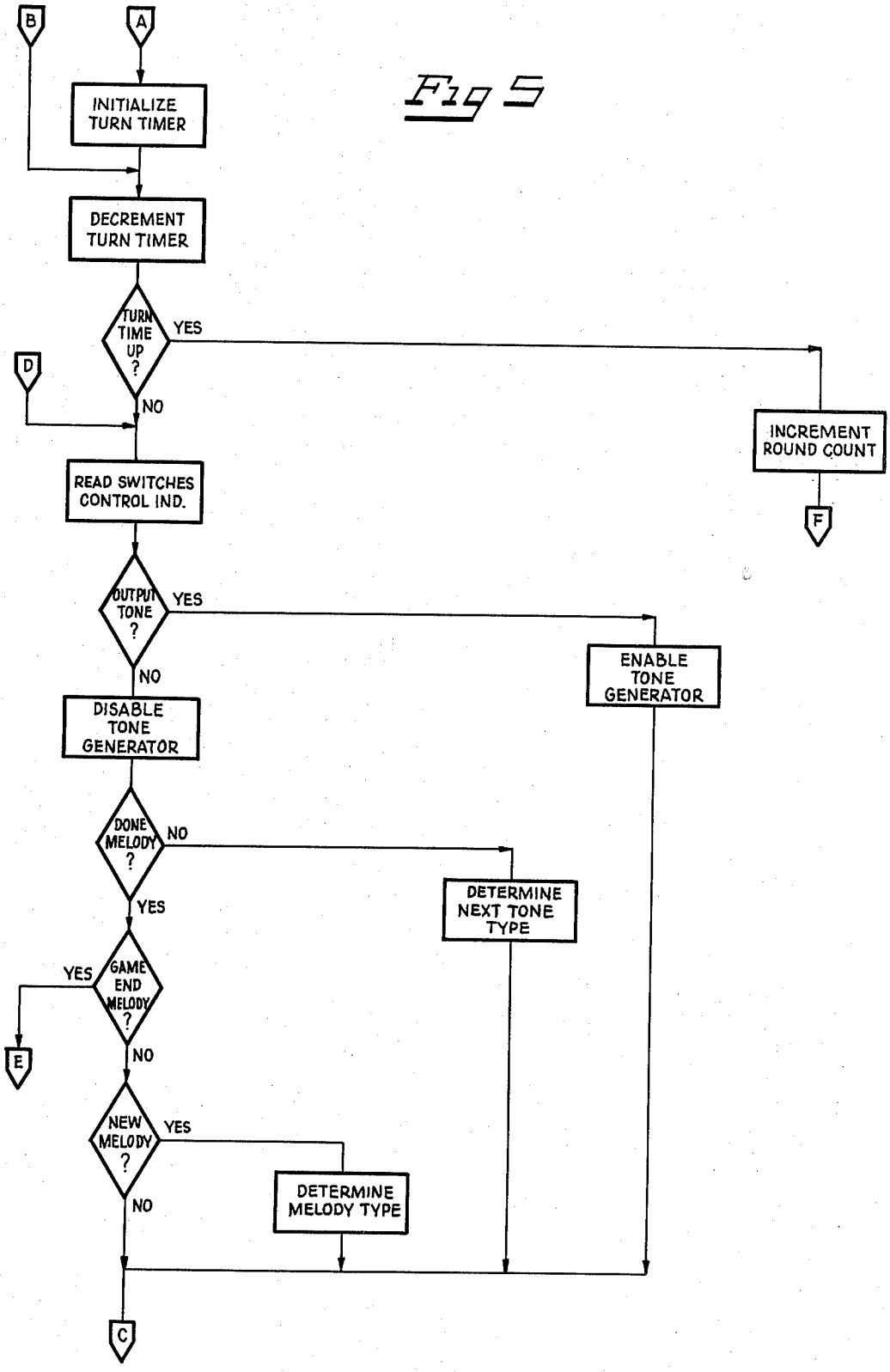

Referring now to FIG. 3, the device 10 illustrated in FIGS. 1 and 2 is readily implemented by a single chip, large scale integrated circuit microprocessor 100 as the main computing device. A TMS 1000 single chip microprocessor manufactured by Texas Instruments, Inc. is suitable for use as the microprocessor 100 and contains the input/output circuitry 82 and the computing device 84 illustrated in FIG. 2. The driver transistors 102, 104, 106, 108, 110, 112, 114, 116, 118 and 120 are provided as part of the input/output circuitry 82, are driven by the outputs of the microprocessor 100 and are utilized to actuate the indicators 40 through 58 respectively. A time delay circuit comprising a capacitor 130 and a diode 132 are utilized to reset and initiate the operation of the microprocessor 100 each time the power is turned on. A timing circuit comprising a capacitor 134 and a resistor 136 control the operation of the internal clock or oscillator of the microprocessor 100. The time delay circuit and timing circuit described above are selected in accordance with the design data and in the manner described in the TMS 1000 series data manual published in December 1975 by Texas Instruments, Inc. Further, the microprocessor 100 is readily programmed in a manner described in this data manual to perform the functions necessary to play the desired games. Flow charts describing the programming of the microprocessor are illustrated in FIGS. 4–6.

In operation and during the play of the game, the microprocessor 100 monitors the state of the push button switches 20 through 38, the control switches 62 and 64 and the game selector switch 60 by sequentially energizing its outputs R0-R9 while monitoring the inputs K1, K2, K4 and K8. Thus, when the output R0 is energized, the device can determine the state of the push button switch 20 by determining whether or not the input K8 is energized. Similarly, the microprocessor 100 when energizing the R1 output can determine whether the switch 22 is energized again by monitoring the state of the K8 input during the time the output R1 is energized. The device monitors the state of the switches 24 through 38 by selective energization of the R2 through R9 outputs while monitoring the K8 input.

During the energization of the outputs R0 through R3, the K1 input is monitored to detect the position of the game selection switch 60; the state of the K1 input during the R0 output interval denoting the game selection switch 60 being in the Game 1 position. The monitoring of the K1 input during the R1–R3 output intervals being associated with the Game 2, 3 and 4 positions respectively. Further, the state of the game start switch 62 is monitored on the K2 input during the R0 output interval and that of the retain switch 64 on the K2 input during the R2 output interval.

The R0 through R9 outputs are also utilized to sequentially drive the transistors 102 through 120 respectively to actuate the corresponding respective indicators 40 through 58 when the $0_o$ output of the microprocessor is simultaneously energized. The $0_o$ through $0_7$ outputs are utilized to drive the respective segments of the displays referred to generally at 66. The displays are selectively energized with the first digit being energized during the R0 output interval and the second digit during the R1 output interval through the respective drive transistors 102 and 104.

The $0_o$ output is connected to one end of each of the indicators 40 through 58 through a drive transistor 140. For example, if LED indicators are utilized for indicators 40 through 58, the output of the driver transistor 140 through a buffer resistor 142 is connected to the anode lead of each of the indicators and the cathode lead of each indicator is connected to the collector of one of the respective drive transistors 102 through 120. Thus, if the indicator 40 is to be energized, during the R0 output interval the $0_o$ output is also energized to actuate the indicator. In this regard, each of the driver transistors 102 through 120 is driven through a series base resistor 144 connected between the base of each transistor and the respective R output lead. A resistor 146 may also be provided for each of the transistors 102 through 120 between the base lead and ground potential.

The tone sequence or melody generation produced through speaker 92 is generated under the control of the R10, R11 and R12 outputs of the microprocessor 100 wherein respective combinations of these outputs are energized to produce the various distinct tone sequence or melody outputs. The R10, R11 and R12 outputs control the frequency or timing of an integrated circuit timer 150 of the control circuitry 94. In a specific embodiment, the timer 150 is a Signetics 555 device. By appropriate timing of the selective energization of the outputs R10 through R12, the timing circuit 150 may be programmed to produce a single sustained tone of a particular frequency or operate to produce a tone sequence of different frequencies. The operational characteristics and circuit descriptions of the Signetics 555 timer to provide various timing and frequency operation is described in Signetics application notes and in *Applications of Linear Integrated Circuits* by Eugene R. Hnatek, John Wiley and Sons Publications, 1975, at pages 421 through 437.

Briefly, the R10 output controls the threshold input of the timer 150 while the R11 and R12 outputs provide two different operational states to the discharge input utilized for the connection of an external timing capacitor. The generation of various tone sequences and melodies will be described in more detail along with a more detailed discussion of the programming and control of the game by the microprocessor 100 in connection with FIGS. 4 through 6.

Referring now to FIGS. 4 through 6, flow charts describing the functions performed by the microprocessor 100 to control the operation of the game according to the invention are illustrated and further define the programming of the microprocessor 100. In this regard, the flow charts illustrated in FIGS. 4 through 6 generally describe operations and programming to implement the play of the Game 1 type described hereinbefore, although it should be understood that the basic programming illustrated in FIGS. 4 through 6 also apply to the other three games and various other games with suitable modifications.

The main logic flow or control loop of the microprocessor 100 originates at the top of FIG. 4 at the START designation with a clear function being performed as to the contents of the memory of the microprocessor as well as the output control circuits. The main control of the microprocessor then proceeds through an increment random number generator function to a decision block START SWITCH DOWN? wherein a determination is made whether or not the start switch 62 has been actuated. If the start switch has not been actuated, the logic control returns to again increment the random number generator and continue to determine whether the start switch has been actuated. If the start switch has been actuated, the logic control proceeds to read the game type as selected on switch 60 and properly initialize the indicators 40 through 58 according to the rules of the game selected as programmed in the microprocessor.

The logic control then proceeds to a determination block RETAIN SWITCH DOWN? to ascertain the state of the retain push button switch 64. If the retain switch is not actuated, the push button switch/indicator association table as stored in memory is erased. However if the retain switch had been actuated (as monitored during a sequential interrogation of the various control switches), the logic control flow or path continues around the erase association table step or function thus retaining the previous switch/indicator association table in memory for its next game.

The logic control path then continues through a marker A of FIG. 4 to marker A of FIG. 5 whereupon the turn timer (performed by the internal timer or oscillator circuit in the microprocessor 100) is initialized to begin the timing of a round or turn with the start of the turn defined at the time a push button switch has been actuated or after the initialization steps in a new game. Next the turn timer is decremented or reduced by one time unit of the predetermined number of time intervals alotted to a turn as determined by the particular programming. Next a determination is made in the TIME UP? decision block whereupon the increment round count is incremented if the answer is yes, defined as the participant taking too long to operate one of the push buttons after the turn has begun. If the answer is no (i.e. the time for a turn is not up due to the most recent time unit decrement of the turn timer) the logic control proceeds to perform the sequential input/output functions to read the state of the push button switches 20 through 38 utilizing internal timing circuits to detect valid push button switch depressions in a debounce counting function. At this time, the logic control also actuates particular indicators 40 through 58 in accordance with the contents of the memory and associated output state circuitry.

After these functions have been performed, the determination is made by the logic control circuitry of the microprocessor in a decision block OUTPUT TONE? as to whether or not an output tone is required at this point. If the output state circuitry indicates that the determination is yes, the tone generator (including timer 150) is enabled and the logic control flow proceeds to marker C at the start of FIG. 6 to define what type of tone sequence or melody is to be performed. If the determination in the OUTPUT TONE? decision block is negative, the tone generator is disabled and the flow proceeds to a determination block DONE MELODY? to determine whether a tone sequence or melody of one of various types is in progress or has been completed. If a tone sequence or melody is currently being performed by the tone generator (which of course is much a slower than the logic control path flow) the control circuitry proceeds to determine the next tone type required to complete the tone sequence or carry on the tone sequence and the flow again proceeds to marker C to determine what type of melody is being performed.

If the tone sequence or current melody has been completed, the flow proceeds to a decision block where the determination is made whether or not the tone sequence or melody performed was a GAME END MELODY? If the determination is yes. the control path proceeds through marker E of FIG. 5 to the reference marker E of FIG. 4 at the start of the main logic control flow path. If the melody completed was not the end of game designation, a determination is made whether or not a new melody (tone sequence) is to be performed as indicated by the NEW MELODY? decision block. If the answer is yes, then a determination is made as to what type of tone sequence or melody is to be performed by interrogation of the memory. If the new melody or tone sequence is to be that of a game end type, the determination is a decision block GAME END MELODY? (marker C of FIG. 6) is yes and the flow continues to reference marker D which enters the main flow path at reference marker D of FIG. 5, the No determination output of the TURN TIME UP decision block.

If the new melody is not the end of game type, the determination is then made in a decision block SWITCH DETECT? as to whether a push button switch operation has been detected since the previous pass around the main logic control flow by interrogating the memory and the output state circuitry. If a push button switch operation has not been stored, the flow proceeds through reference marker B to reference marker B of FIG. 5 between the initialize turn timer and decrement turn timer functions.

If a push button switch operation has been detected, the round count is incremented and stored for subsequent use to update the display. Next a determination is made in a decision block INDICATOR TO SWITCH LINK? where the determination is made whether or not an association table between the indicators and push button switches has been previously established in memory. If the answer is yes, the particular indicator associated with the push button switch that has been operated is recalled.

Next a determination is made in decision block CORRECT SWITCH? to determine whether this is the correct push button switch corresponding to the present position of the sequence thus far established in memory as correctly performed by the game participant. If the determination in the INDICATOR TO SWITCH LINK? decision block is NO, i.e. there is no indicator/-push button association table currently in memory denoting the start of a game, a random number generator is interrogated and an indicator push button association table is generated and stored for further use.

The logic control flow proceeds to the decision block CORRECT SWITCH? If the operated push button switch is the next switch in the sequence as determined by the association table in memory, the display is updated and the logic control flow proceeds to a decision block GAME END? to determine if this is the switch corresponding to the last element in the stored sequence. If the determination is yes, the logic flow proceeds through an initialize game end melody function to establish the proper state of the internal logic to prepare for the generation of a game end melody.

The logic control path proceeds through the reference marker A of FIG. 6 to marker A at the top of FIG. 5 to initialize the turn timer and again proceed through the logic control flow of FIG. 5. Proceeding through the control path of FIG. 5 as previously described, if the determination of the GAME END? decision block is no, the correct switch melody is initialized and again the logic control path continues to reference marker A to the initialize turn timer functional block of FIG. 5 to proceed through another turn and to output a correct switch melody. Returning now to FIG. 6, if the determination in the decision block CORRECT SWITCH is NO, the display is updated from the information previously stored in the increment round count position in memory and the wrong switch melody logic is initialized. Again, the logic control path now proceeds to reference marker A.

The reference marker F continued from the reference marker F of FIG. 5 at the output of the increment round count function, enters the logic control path at the initialize wrong switch melody and again back to the reference marker A. Thus, if the turn timer times out at the TURN TIME UP? decision block before the participant selects and operates the next push button, the wrong switch melody is initialized and thereafter produced as if a wrong push button had been actuated along with an increment of the round count.

Obviously many modifications and variations of the present invention are possible in light of the above teachings. Thus, it is to be understood that, within the scope of the appended claims, the invention may be practiced otherwise than as specificially described above.

What is claimed and desired to be secured by Letters Patent of the United States is:

1. An electronic game device comprising:

means actuable by a participant for entering a first sequence represented by the order of actuation of said entering means, said entering means comprising a first plurality of individually manually operable means;

means coupled to said entering means for comparing said first sequence with a second sequence stored in said comparing means;

means coupled to said comparing means for displaying the agreement between said first and second sequences, said displaying means comprising a second plurality of indicating means; and means for internally generating said second stored sequence on a random basis, said second sequence representing a correspondence relationship associating said first plurality of manually operable means and said second plurality of indicating means, said comparing means comprising means for controlling said display means to actuate said indicating means corresponding to said associated manually operable means upon actuation of said particular manually operable means, said comparing means further comprising means for storing the agreement between said first and second sequences and controlling said display means to continuously energize the indicating means corresponding to the number of sequence positions in agreement and penalty means for modifying said stored agreement in said storing means in response to actuation of a manually operable means corresponding to an indicating means and representing a position in said second sequence already stored in said storing means.

2. An electronic game device as recited in claim 1 wherein said first and second pluralities are equal.

3. An electronic game device as recited in claim 1 wherein said correspondence relationship is a one-to-one relationship.

4. An electronic game device as recited in claim 1 wherein said first plurality is different than said second plurality.

5. An electronic game device as recited in claim 4 wherein said first plurality is greater than said second plurality, the difference between said first and second pluralities representing unassociated elements between said first plurality of manually actuable means and said second plurality of indicating means.

6. An electronic game device as recited in claim 1 further comprising round counting means coupled to said entering means for displaying the total number of actuations of said first plurality of manually operable means.

7. An electronic game device as recited in claim 1 wherein said comparing means operates to determine agreement between said first and second sequences from the beginning of said second sequence.

8. An electronic game device as recited in claim 1 wherein said storing means is unaffected by the entering of incorrect sequence entries that are different than said second stored sequence in said storing means.

9. An electronic game device as recited in claim 1 wherein said comparing means disregards entries from said manually operable means not in agreement with respect to said second sequence and different than said second stored sequence in said storing means.

10. An electronic game device as recited in claim 1 wherein said penalty modifying means deletes the stored agreement portion of said second sequence in said storing means in accordance with the relative representative position of said indicating means in said stored agreement portion.

11. An electronic game device as recited in claim 1 further comprising means responsive to said comparing means for generating a sensorially perceptible error indication in response to actuation of a manually operable means not in agreement with said second sequence.

12. An electronic game device as recited in claim 1 further comprising means responsive to said comparing means for generating a predetermined number of sensorially distinct, perceptible outputs in response to said entering of said first sequence.

13. An electronic game device as recited in claim 12 wherein said predetermined number of sensorially perceptible outputs comprises at least three distinct outputs respectively representing: an entry of said first sequence entering means in agreement with said second sequence; an entry of said first sequence not in agreement with said second sequence; and the entry of said entire first sequence in agreement with said entire second sequence.

14. An electronic game device as recited in claim 13 wherein said three distinct outputs correspond respectively to a correct attempt, an incorrect attempt and a completion of game sequence.

15. An electronic game device as recited in claim 12 wherein said sensorially perceptible outputs are aural.

16. An electronic game device as recited in claim 15 wherein at least one of said aural outputs comprises a combination of successive tones of different frequencies.

17. An electronic game device as recited in claim 1 wherein said comparing means comprises means for programming said comparing means to perform the comparing of said first sequence to said second sequence starting at a predetermined position of said second sequence and progressing from position to position in said second sequence in either direction.

18. An electronic game device as recited in claim 1 further comprising means for controlling said electronic game device to operate in a predetermined number of different operational modes, said controlling means comprising manually operable means for selecting said predetermined number of different operational modes.

19. An electronic game device comprising:

a base;

a first plurality of manually operable entry devices operable by one or more game participants and disposed on said base is a predetermined pattern;

a second plurality of indicators disposed on said base in said predetermined pattern, one of said indicators being disposed adjacent each of said manually operable entry devices;

manually operable start means; and electronic control means responsive to said manually operable start means and said first plurality of manually operable entry devices for controlling operation of said second plurality of indicators, said electronic control means comprising, means responsive to said manually operable start means for generating and storing a correspondence association sequence that corresponds to each of said first plurality of manually operable entry devices with a respective one of said second plurality of indicators, said correspondence association sequence generating and storing means generating said sequence on a random basis, entry control means responsive to operation of said entry devices for comparing the operation of said entry devices with a compared sequence element of said stored correspondence association sequence, said entry control means comprising means for providing one of said sequence elements of said correspondence association sequence representing a compared sequence element, means for comparing operation of said entry devices with said stored correspondence association sequence starting with the first element of said stored correspondence association sequence and proceeding sequence element by sequence element in said stored correspondence association sequence, means for advancing said sequence element providing means and the compared sequence element of said correspondence association sequence by one element upon said comparing means sensing agreement upon operation of said entry device corresponding to the compared sequence element, and means for generating a first non-agreement signal when said operated entry device is not in agreement with said compared sequence element and a second agreement signal when said operated entry device is in agreement with said compared sequence element, and indicator control means responsive to said entry control comparing means for momentarily actuating the indicator means that corresponds to the operated entry means in response to said first non-agreement signal and continuously actuating the indicator means that corresponds to the operated entry means in response to said second agreement signal.

20. An electronic game device comprising:

a base;

a first plurality, 1 to 2n, of manually operable entry means operable by two game participants and disposed on said base in a predetermined array;

a second plurality, 1 to 2n, of indicators disposed on said base in said predetermined pattern, one of said indicators being disposed adjacent each of said manually operable entry means;

manually operable start means;

initializing control means responsive to said start means for actuating the first half, 1 to n, of said second plurality of indicators and maintaining deactuated the last half, n+1 to 2n, of said second plurality of indicators;

sequence generating means responsive to said start means for generating and storing a random correspondence association sequence that corresponds to each of said first plurality of manually operable entry means with a respective one of said second plurality of indicators;

entry sensing means responsive to operation of said entry means for generating a signal representing the identification of the entry means that is operated;

first control means responsive to said entry sensing means and said sequence generating means for comparing operation of said entry means with a first predetermined comparison sequence element of said correspondence association sequence starting from the first indicator of said second plurality of indicators, said first control means comprising means for controlling deactuation of said indicators, said deactuation control means deactuating said first indicator upon operation of said entry means corresponding to said first indicator, said first control means further comprising means for generating a first sequence element advance signal in response to operation of said entry means corresponding to said first predetermined comparison sequence element, said first predetermined comparison sequence element being advanced by one element in said correspondence association sequence upon the occurrence of each first sequence element advance signal, said first control means further comprising means responsive to operation of said entry means not in agreement with said first predetermined comparison sequence element to momentarily deactuate the indicator corresponding to said operated entry means if said respective indicator is currently actuated, said deactuation control means further deactuating the indicator corresponding to the first predetermined comparison sequence element upon operation of the associated entry means if said respective indicator is currently actuated; and second control means responsive to said entry sensing means and said sequence generating means for comparing operation of said entry means with a second predetermined comparision sequence element of said correspondence association sequence starting from the first indicator, n+1, of said second half, n+1 to 2n, of said second plurality of indicators, said first control means comprising means for controlling actuation of said indicators, said actuation control means actuating said first indicator, n+1, of said second half of said indicator upon operation of said entry means corresponding to said n+1 indicator, said second control means further comprising means for generating a second sequence element advance signal in response to operation of said entry means corresponding to said second predetermined comparison sequence element, said second predetermined comparison sequence element being advanced by one element in said correspondence association sequence upon the occurrence of each second sequence element advance signal, said second control means further comprising means responsive to operation of said entry means not in agreement with said second predetermined comparison sequence element to momentarily actuate the indicator corresponding to said operated entry means if said respective indicator is currently deactuated, said actuation control means further actuating the indicator corresponding to the second predetermined comparison sequence element upon operation of the associated entry means if said respective indicator is currently deactuated, said second control means continuing to advance said second predetermined sequence element from the indicator n+1 to the indicator 2n, to the indicator 1 and to the indicator n.

* * * * *